United States Patent [19]

Keller et al.

[11] 3,973,523

[45] Aug. 10, 1976

[54] VAPOR GENERATOR

[75] Inventors: Arthur Keller, Akron; Neil J. Monroe, Wadsworth, both of Ohio

[73] Assignee: The Babcock & Wilcox Company, New York, N.Y.

[22] Filed: Mar. 17, 1975

[21] Appl. No.: 559,345

[52] U.S. Cl. ..... 122/510; 122/478

[51] Int. Cl.[2] ..... F22B 37/24

[58] Field of Search ..... 122/235 H, 494, 510, 122/478

[56] References Cited

UNITED STATES PATENTS

| | | | |
|---|---|---|---|
| 1,939,535 | 12/1933 | Badenhausen | 122/235 |
| 2,515,443 | 7/1950 | Ebbets | 122/510 |
| 2,774,340 | 12/1956 | Jankowski | 122/510 |
| 3,212,481 | 10/1965 | Mumford et al. | 122/510 |
| 3,266,467 | 8/1966 | Winship | 122/510 |
| 3,280,800 | 10/1966 | Sullivan | 122/510 |

*Primary Examiner*—Kenneth W. Sprague
*Attorney, Agent, or Firm*—J. M. Maguire; R. J. Edwards

[57] ABSTRACT

A bottom supported vapor generator including rigid means supporting the drums and generating tube banks, and resilient means supporting the furnace tube walls and headers.

4 Claims, 10 Drawing Figures

FIG. 6
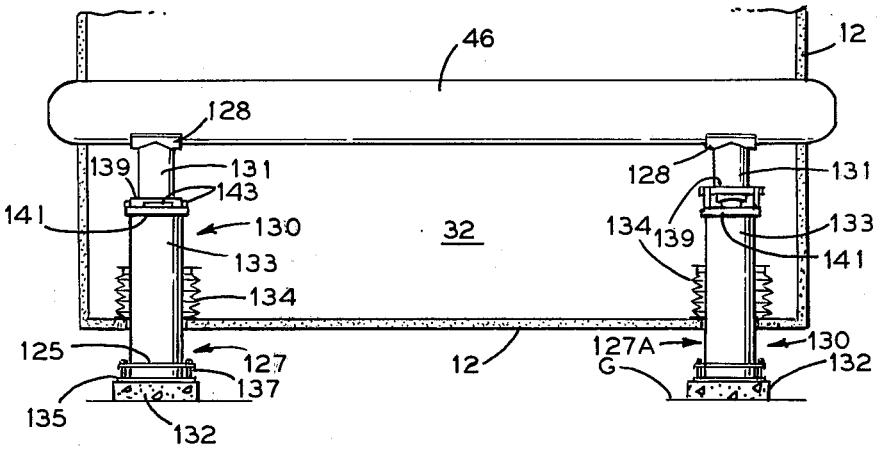
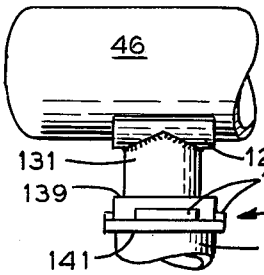
FIG. 2A
FIG. 2B
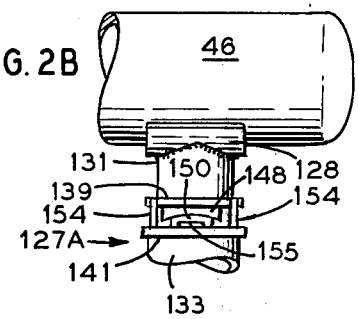
FIG. 7
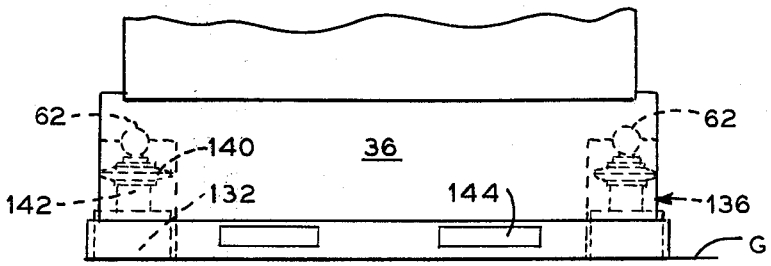
FIG. 2D
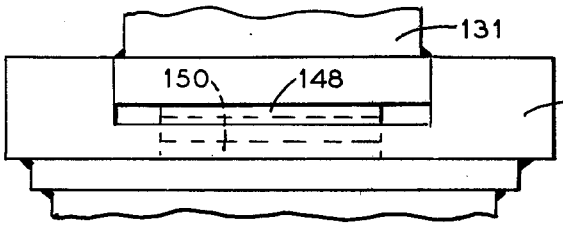
FIG. 2C
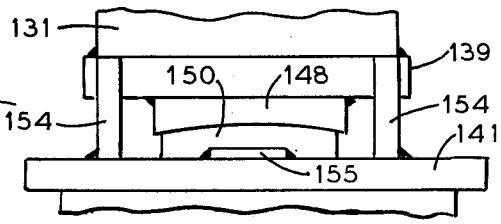

VAPOR GENERATOR

BACKGROUND OF THE INVENTION

The present invention relates to vapor generators and more particularly to a support system for bottom supported vapor generating units.

It is customary to support the generating tube banks and the furnace wall tubes of a vapor generator from the drums or headers to which they are connected. Vapor generating units may be top or bottom supported.

A top supported unit is one where the furnace wall tubes and lower headers are supported from the upper headers, and the generating tube banks and lower drum are supported from the upper drum. The upper drum and headers are connected through hangers to a vertical steel structure providing a fixed support. As the top supported unit is brought up to operating temperature, the drums and tube banks and the furnace wall tubes and headers undergo thermal expansion in a downward direction from the point of restraint at the hangers. A top supported unit has the economic disadvantage of larger initial capital investment attributable to the need for higher headroom and the relatively large quantity of steel required by the support structure.

A bottom supported unit is one where the generating tube banks and upper drum are supported from the lower drum, and the furnace wall tubes and upper headers are supported from the lower headers. The lower drum and headers rest on columns positioned therebeneath. As the bottom supported unit is brought up to operating temperature, the drums and generating tube banks and the furnace wall tubes and headers undergo thermal expansion in an upward direction from the point of restraint at the columns. Heretofore, in bottom supported units, it has been necessary to limit the difference in elevation between the lower drum and the lower furnace wall headers so as to avoid excessive stresses on these and associated parts occasioned by relative vertical expansion movements between the furnace wall tubes and headers and the generating tube banks and drums. This limitation imposes a definite restriction on the height of the furnace chamber relative to that of the drums and generating tube banks, and consequently limits the vapor generating capacity of such units for a given width.

SUMMARY OF THE INVENTION

The present invention is directed at a support arrangement for accommodating the difference in thermal expansion occasioned by the greater vertical dimension of the furnace wall tubes and headers as compared to that of the drums and generating tube banks. The support arrangement of the invention permits the establishment of a furnace height greater than the height of the drums and generating tube banks and removes the limitation imposed on the difference in elevation between the lower drum and the lower furnace wall headers and provides the necessary freedom for thermal expansion.

Accordingly, there is provided a bottom supported vapor generating unit comprising walls forming a setting containing pressure parts including horizontally extending upper and lower drums and at least one bank of vapor generating tubes connected at their opposite ends to the drums. Some of the setting walls include upright tubes forming sides of a furnace chamber, and connected at their opposite ends to horizontally extending upper and lower headers. The arrangement includes rigid means for bottom supporting the lower drum, and constituting the normal support for substantially all of the weight of the drums and generating tube bank, and resilient means for bottom supporting at least some of the lower headers of the furnace sides, and constituting the normal support means for substantially all of the weight of the headers and upright tubes.

The resilient means are preferably in the form of disc springs selected for their ability to withstand the dead weight load supported therefrom while compensating for the difference in vertical thermal expansion movement occasioned by the greater height of the furnace chamber as compared to that of the drums and generating tube bank. The resilient means permit the expansion difference attributable to the added furnace height to move downwardly thereby resulting in an upward expansion movement of the furnace wall tubes and headers which is substantially equal to that of the drums and generating tube banks.

BRIEF DESCRIPTION OF THE DRAWINGS

FIG. 2A is a detail view of the fixed bottom support arrangement associated with the drums and generating tube banks.

FIGS. 2B, 2C and 2D are detail views of the slidable bottom support arrangement associated with the drums and generating tube banks.

FIG. 6 is a view of the bottom supported lower drum.

FIG. 7 is a view of the bottom supported lower headers.

DESCRIPTION OF THE PREFERRED EMBODIMENTS OF THE INVENTION

Figure 1:
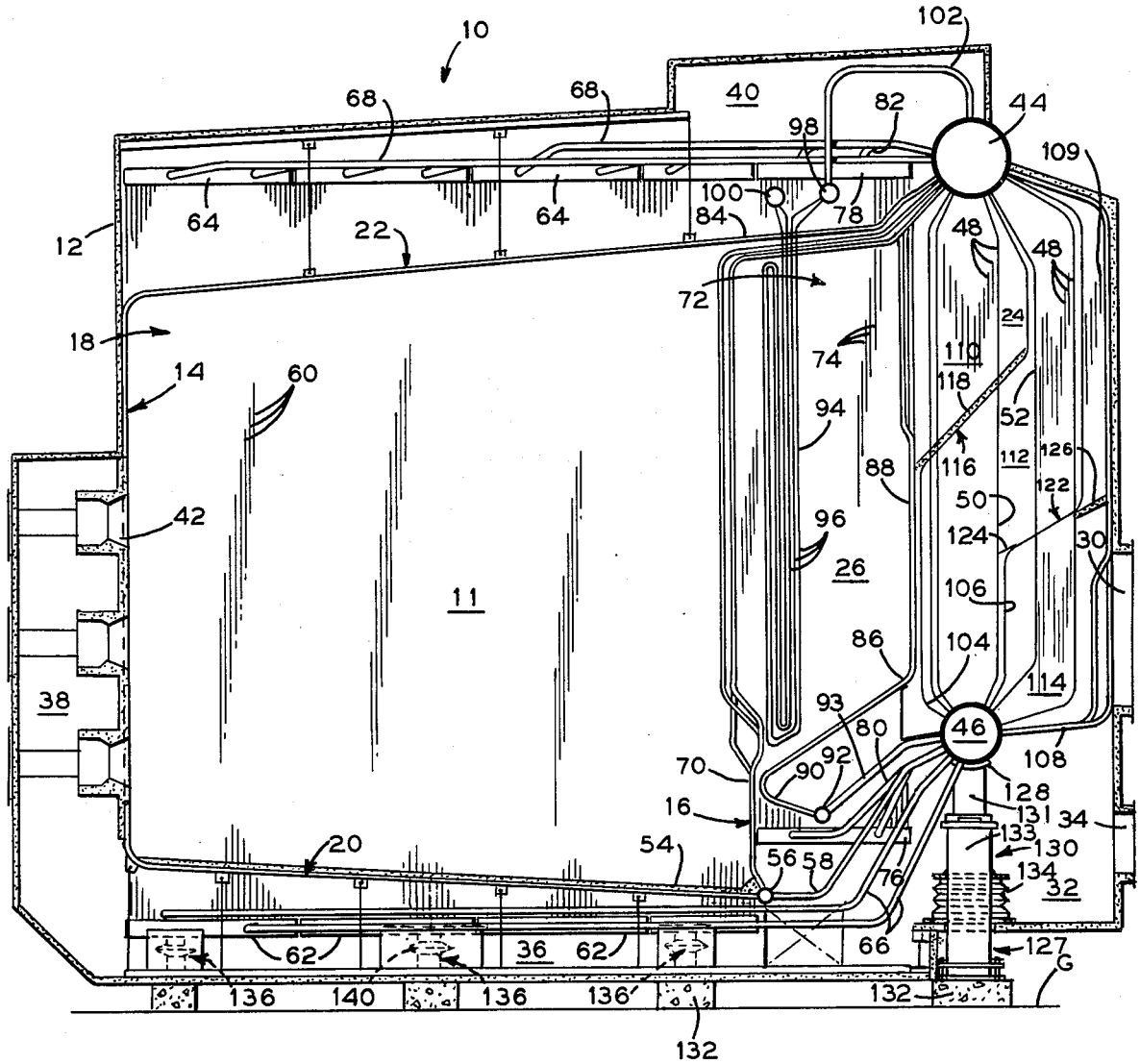
FIG. 1 is a sectional side elevation of a bottom supported vapor generator embodying the invention.

Referring to FIG. 1, there is shown a vapor generator comprising a setting 10 whose outer boundary is defined by an insulated casing 12. The setting 10 is of substantially rectangular cross section and comprises a furnace chamber 11 defined by fluid cooled walls including a front wall 14, a lower rear wall 16, side walls 18, a floor 20 and a roof 22. The furnace walls are formed with spaced parallel tubes having substantially all of their intertube spacing closed by metallic webs. The rear portion of the setting includes a generating section gas space 24 and a superheater gas passage or cavity 26, the latter being disposed intermediate the furnace 12 and gas space 24. The gas space 24 is formed with an outlet 30 for discharge of gases from the setting 10. The lower portion of the setting 10 includes an air chamber 32 having an inlet 34 for admission of combustion air to the setting 10, and a duct 36 connecting the air chamber 32 to a windbox 38 located at the front end of the setting 10. The upper portion of the setting 10 includes a header vestibule 40.

The vapor generator is fired by a plurality of burners (not shown) arranged to discharge through refractory lined ports 42 located in the furnace front wall.

The vapor generator pressure parts include horizontally disposed upper and lower drums 44 and 46 having their longitudinal axis lined in substantially the same vertical plane and being connected to one another through upright fluid conducting tubes 48 arranged in horizontally spaced banks 50 and 52. The pressure parts also include fluid conducting tubes for all the furnace walls. The front wall 14, the floor 20 and the roof 22 include a row of tubes 54 connected at their lower ends to a header 56 and their upper ends to the drum 44, with the fluid being provided through supply tubes 58 extending between the lower drum 46 and the header 56. Each furnace side wall 18 includes a row of tubes connected at their opposite ends to the lower and upper headers 62 and 64, with fluid being provided through supply tubes 66 extending between lower drum 46 and the headers 62 and fluid discharge being provided by riser tubes 68 extending between headers 64 and the upper drum 44. The furnace lower rear wall 16 includes a row of tubes 70 connected at their lower ends to the header 56 and their upper ends to the drum 44, with the upper portions of these tubes arranged to form a screen ahead of the superheater cavity 26.

The pressure parts further include the superheater cavity walls which comprise the side walls 72 disposed laterally adjacent to the furnace side walls 18 and having a row of tubes 74 connected at their opposite ends to the lower and upper headers 76 and 78, with fluid admission being provided through supply tubes 80 extending between the lower drum 46 and the header 76 and fluid discharge being provided by riser tubes 82 extending between header 78 and the upper drum 44. The superheater cavity roof 84, which is an extension of the furnace roof 22, is defined by the upper end portion of tubes 54. The superheater cavity floor 86 and lower rear wall 88 include a row of tubes 90 connected at their lower ends to a header 92 and their upper ends to the drum 44, with the upper portion of these tubes arranged to form a screen ahead of the generating section gas space 24 and with fluid admission being provided through supply tubes 93 extending between the lower drum 46 and the header 92.

The pressure parts also include a superheater 94 comprising upright return bend tubes 96 spaced across the width of cavity 26 and connected at their opposite ends to headers 98 and 100, with vapor admission being provided through a row of saturated vapor supply tubes 102 extending between the upper drum 44 and the header 98, and steam discharge taking place through one or more outlet pipes (not shown) leading from the header 100.

The pressure parts further include the rows of tubes 104, 106, 108 and 109 connected at their opposite ends to the upper and lower drums 44 and 46. The tubes 109 line side walls of gas space 24 and the tubes 104, 106 and 108 partition the gas space 24 into first, second and third gas passages 110, 112 and 114 extending the width of gas space 24 and being serially disposed in the direction of gas stream flow. The tubes 104 have intermediate portions thereof lying in an inclined plane and interlaced with tubes 48 of the bank 50 to form a water cooled baffle 116 including refractory lined metal plates 118 extending along the top of the inclined tube portions, with the upper portions of tubes 104 being arranged to form a screen ahead of the second gas passage 112. The tubes 106 have lower portions thereof arranged to form a screen ahead of the third gas passage 114, and intermediate portions thereof lying in an inclined plane and interlaced with tubes 48 of the bank 52 to form part of a baffle 122 including metal plates 124 extending along the top of the inclined tube portions, the remainder of the baffle 122 being formed of a refractory lined reinforced plate 126 extending the width of the gas space 24. The tubes 108 have intermediate portions thereof arranged to form a screen ahead of the outlet 30, and upper portions thereof lining the rear wall of the setting 10.

In accordance with the invention, the pressure parts of the vapor generator are arranged for bottom support which allows the establishment of a furnace having a greater vertical dimension than that of the drums and generating tube banks and removes the limitation imposed on the difference in elevation between the lower drum and the lower furnace wall headers.

Referring to FIGS. 1 and 6, there are shown the bottom support arrangements 127 and 127A having upper portions thereof located in chamber 32, near the ends of the lower drum 46, and including the saddles 128 fixedly connected to the drum 46, preferably by welding the edge of the saddles to the outer surface of the drum. The saddles are supported by columns 130 comprising upper and lower rigid tubular members 131 and 133, the latter extending through the insulated casing 12 and including the support and base plates 125, 135 and the bolts for anchoring the columns 130 to the foundation piers 132. The adjacent ends of tubular members 131 and 133 are capped by bearing plates 139 and 141, respectively. Expansion seals 134 provide an airtight closure between the lower members 133 and the casing 12 while compensating for movement due to thermal expansion of the casing 12.

The support arrangement 127 has the bearing plate 139 resting on plate 141 which includes stops 143 welded thereon and abutting the sides of plates 139 to prevent longitudinal and lateral movement of the lower drum 46.

The support arrangement of 127A has the bearing plates 139 and 141 spaced from one another and includes slidable plate means interposed therebetween for accommodating longitudinal thermal expansion of the lower drum 46.

Substantially all of the weight of the drums 44, 46; the tube banks 50, 52; the tube rows 90, 104, 106, 108, 109; the header 92; and a portion of the weight of the superheater 94; the headers 56, 76, 78, 98, 100; the tube rows 70, 74; the supply tubes 58, 66; the riser tubes 68, 82; the saturated vapor supply tubes 102; and the weight of the portion of insulation, casing, plates and refractory associated with and in proximity to the aforementioned pressure parts are taken by the support arrangements 127 and 127A including upright columns 130 which are preferably of tubular structure and are of sufficient diameter and thickness to resist bending moment stresses and to withstand the compression forces transmitted to them.

Referring to FIGS. 1 and 7, there are shown the bottom support arrangements 136 located outside of the duct 36 and beneath the lower headers 62 and including disc springs 140 supported by relatively short upright columns 142, the latter being bolted to foundation piers 132 resting at level G. Vents 144 promote air circulation thereby preventing the overheating of the underside of duct 36.

Substantially all of the weight of the tube row 54 forming the furnace front wall 14, floor 20 and roof 22; the tube rows 60 forming the side walls 18; the headers 62, 64; and the remainder of the weight of the pressure parts, insulation casing, refractory and plates, not supported by the columns 130, are taken by the support arrangements 136 including the disc springs 140 which are pre-set to support the dead weight load of the vapor generator and to compensate for the difference in vertical expansion movement occasioned by the greater height of the furnace side walls 18 as compared to that of the drums 44, 46 and generating banks 50, 52.

Referring to FIG. 2A, there is shown an upper portion of the support arrangement 127 including the lower drum 46 fixedly seated in the saddle 128. The tubular member 131 has its upper end weldably connected to the saddle 128 and its lower end capped by the bearing plate 139, the latter resting on a like plate 141 of somewhat larger dimension and used for capping the upper end of tubular member 133. The stops 143 are welded to the plate 141 and abut the sides of plate 139 thereby preventing lateral and longitudinal movement of the lower drum 46.

Referring to FIGS. 2B, 2C and 2D there is shown an upper portion of the support arrangement 127A including the lower drum 46 fixedly seated in the saddle 128. The tubular member 131 has its upper end weldably connected to the saddle 128 and its lower end capped by the bearing plate 139, the latter being vertically spaced from a like plate 141 of somewhat larger dimension and used for capping the upper end of tubular member 133. The slidable plate means is disposed between the bearing plates 139 and 141, and includes a sole plate 148 welded to plate 139 and having a concave underside engaging the convex topside of a graphite lubricated pad 150. The mating curved surfaces allow for lower drum rotation in a vertical plane while maintaining contact between the sole plate 148 and the graphite lubricated pad 150 at all times. The bottom surface of the pad 150 is slidable engaged with the top surface of the bearing plate 141 and cooperates therewith to accommodate longitudinal thermal expansion of the lower drum 46. The stops 154 and 155 are welded to the upper surface of plate 141. The stops 154 are horizontally spaced from the sole plate 148 and prevent longitudinal movement of the lower drum 46 other than that occasioned by thermal expansion. The stops 154 are formed with shoulder-like portions slidably abutting the sides of plate 139 to prevent lateral movement of the lower drum 46 while allowing longitudinal movement thereof. The stops 155 laterally abut the graphite lubricated pad 150 and allow only longitudinal movement thereof.

Figure 3:
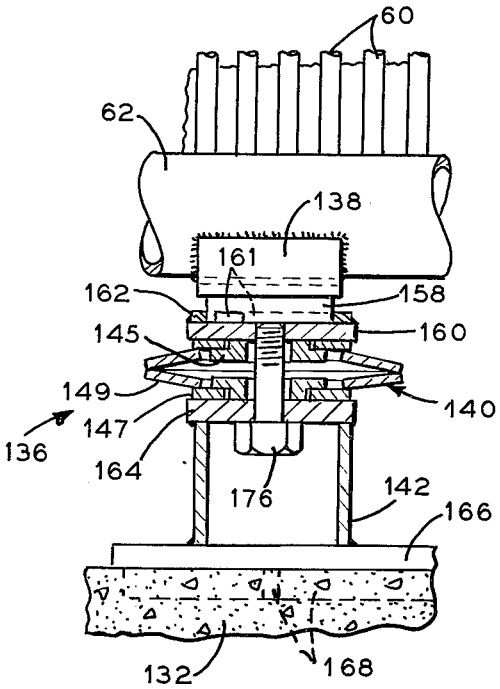
FIG. 3 is a detail sectional side view of the bottom support arrangement associated with the furnace wall tubes and headers.
Figure 4:
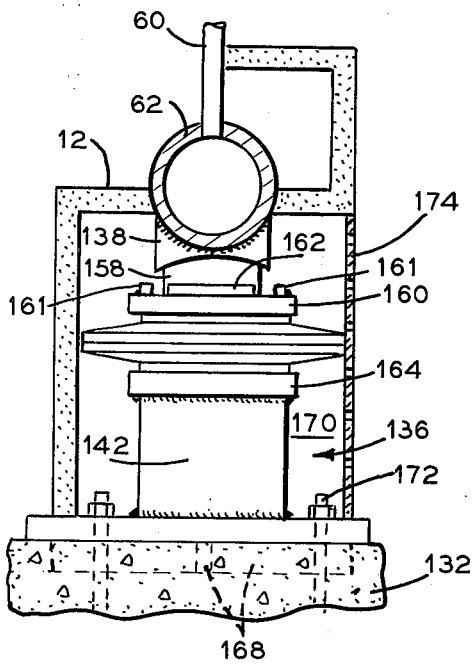
FIG. 4 is a detail end view of the bottom support arrangement associated with the furnace wall tubes and headers.

Referring to FIGS. 3 and 4, there is shown the support arrangement 136 with the membraned side wall tubes 60 extending into the lower header 62 and including having the saddle 138 fixedly connected to the header 62, preferably by welding the edge of the saddle 138 to the outer surface of the header 62. The saddle 138 is formed with a concave underside slidably engaging the convex topside of a graphite lubricated pad 158 and cooperating therewith to accommodate longitudinal thermal expansion of the header 62. The pad 158 is slidably engaged with the bearing plate 160 and cooperates therewith to accommodate lateral thermal expansion at the header 62. The stops 161 and 162 are welded to the upper surface of plate 160. The stops 161 are horizontally spaced from the pad 158 and prevent lateral movement of the header 62 other than that occasioned by thermal expansion. The stops 162 abut the pad 158 and prevent longitudinal movement thereof. A like bearing plate 164 is disposed in subjacent spaced relation to the plate 160 and covers the upper end of a tubular member 142 being weldably connected therewith. The lower end of tubular member 142 is weldably connected to a base plate 166, the latter having ribs 168 formed along the underside thereof and embedded in the concrete foundation pier 132, and including bolts 172 anchoring the plate 166 to the pier 132. The support arrangement 136 is located outside of the duct and is separated therefrom by insulated casing 12. A perforated protective plate 174 cooperates with the casing 12 to form the space 170 used to house the support arrangement 136.

In accordance with the invention, there is provided a resilient means interposed between the bearing plates 160 and 164 to accommodate the difference in vertical expansion movement resulting from the added height of the side walls 18 and headers 62, 64 as compared to that of the drums 44, 46 and generating tube banks 50, 52. The resilient means comprise a pair of disc springs 140 contacting one another along the outer periphery of their dished faces, with each being fastened to a respective one of the plates 160 and 164 by retainer rings 145, the latter being welded to the plate associated therewith. Each disc spring 140 includes an annular dished plate or belleville washer 149 having an inner peripheral portion thereof resting on a flat annular plate or washer 147, the latter being secured by the retainer 145. The bearing plates 160 and 164 include openings centrally aligned with the annular plate 147 and suitable for receiving a spring load adjustment bolt 176 abutting against the underside of bearing plate 164 and threadably engaged with the bearing plate 160. A pre-set adjustment is obtained by threading the bolt 176 to draw the plate 160 toward the plate 164 thereby loading the discs 140 so that the spring force balances the dead weight supported therefrom. As water is added to the vapor generator, the spring will begin to deflect and will thereafter further deflect to accommodate the difference in vertical thermal expansion attributed to the added height of the furnace walls and headers as compared to that of the drums and tube banks.

Figure 5:
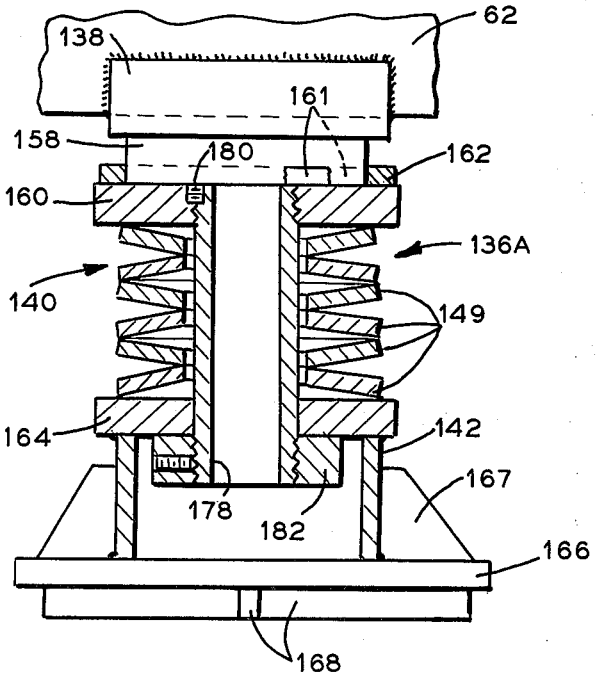
FIG. 5 is a detail sectional side view of an alternate bottom support arrangement associated with the furnace wall tubes and headers.

Referring to FIG. 5, there is shown an alternate support arrangement 136A depicting a fragmented portion of the lower header 62 and including having the saddle 138 weldably connected to the header 62 and formed with a concave underside slidably engaging the convex topside of the graphite lubricated pad 158 and cooperating therewith to accommodate longitudinal thermal expansion of the header 62. The stops 161 and 162 wee welded to the upper surface of plate 160. The stops 161 are horizontally spaced from the pad 158 and prevent lateral movement of the header 62 other than that occasioned by thermal expansion. The stops 162 abut the pad 158 and prevent longitudinal movement thereof. The like bearing plate 164 is disposed in subjacent relation to the plate 160 and covers the upper end of the tubular member 142 weldably connected therewith. The lower end of tubular member 142 is weldably connected to the base plate 166, the latter including stiffeners 167 and the ribs 168.

In accordance with the invention, there is provided an alternate resilient means interposed between the bearing plates 160 and 164 and comprising a plurality of stacked disc springs 140 in the form of annular dished plates or belleville washers 149 contacting one another along adjacent inner and outer peripheries. The uppermost and lowermost annular plates 149 have their outer periphery contacting the bearing plates 160 and 164 respectively, while the intermediate plates 149 contact one another along adjacent inner and outer peripheries. The bearing plates 160 and 164 include openings centrally aligned with the annular plates 149. An end threaded hollow bolt 178 is threadably engaged with the bearing plate 160 and is locked thereon by a set screw 180. A pre-set adjustment is obtained by threading a nut 182 onto the bolt 178 and drawing the plate 160 toward plate 164 thereby loading the discs 140 so that the spring force balances the dead weight load supported therefrom. As water is added to the vapor generator, the springs will begin to deflect and will thereafter further deflect to accommodate the difference in vertical thermal expansion attributed to the added height of the furnace walls and headers as compared to that of the drums and tube banks.

In the operation of the vapor generator, air and fuel are fed to the furnace in controlled quantities and combustion of the fuel takes place at a relatively rapid rate. All of the heating gases flow through the furnace 11 and over the screen tubes, the superheater 94 and the generating tube banks 50, 52 to the gas outlet 30. The last several tube rows, with respect to gas flow, of the bank 52 serve as downcomer or fluid supply tubes for the remaining portion of bank 52 and for bank 50, and tube rows 104, 106, 108, 109, and for the supply tubes 58, 66, 80 and 93 delivering the required supply of fluid to the furnace and superheater cavity walls. The fluid in the portion of the circulation circuits including the furnace and superheater cavity walls and the generating tubes other than the downcomer tubes is mixture of steam and water at saturation temperature corresponding to the drum pressure.

While in accordance with the provisions of the statutes there is illustrated and described herein a specific embodiment of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A bottom supported vapor generating unit comprising walls forming a setting containing pressure parts including horizontally extending upper and lower drums, at least one bank of upwardly oriented tubes connected at their opposite ends to said drums, some of the walls including upright tubes forming sides of a furnace chamber, said upright tubes being connected at their opposite ends to horizontally extending upper and lower headers, the lower headers being disposed substantially below said lower drum, and means for bottom supporting the lower drum including rigid upright columns at spaced positions along the length thereof, said bottom support means constituting the normal support means for substantially all of the weight of said drums and tube banks, and means for bottom supporting at least some of the lower headers including resilient means at spaced positions along the length thereof, said last named bottom support means constituting the normal support means for substantially all of the weight of said upper and lower headers and upright tubes.

2. The bottom supported vapor generating unit according to claim 1 including some of the walls having upright tubes forming sides of a gas passage, a superheater disposed within the gas passage, and wherein a portion of the weight of the gas passage sides and superheater is supported by said drum bottom support means and the remainder of the weight of said gas passage sides and superheater is supported by said header bottom support means.

3. The bottom supported vapor generating unit according to claim 1 wherein said resilient means include disc springs.

4. The bottom supported vapor generating unit according to claim 1 wherein the drum and header support means include slidable plate means.

* * * * *

UNITED STATES PATENT AND TRADEMARK OFFICE

CERTIFICATE OF CORRECTION

PATENT NO. : 3,973,523

DATED : August 10, 1976

INVENTOR(S) : Albert Eisenstein

It is certified that error appears in the above-identified patent and that said Letters Patent are hereby corrected as shown below:

Column 6, line 53; "wee" should read --are--.

Claim 1, line 21 "banks" should read --bank--.

Signed and Sealed this

*Twenty-fourth* Day of *January 1978*

[SEAL]

*Attest:*

RUTH C. MASON
*Attesting Officer*

LUTRELLE F. PARKER
*Acting Commissioner of Patents and Trademarks*